US010774628B2

(12) United States Patent
Knoeller

(10) Patent No.: US 10,774,628 B2
(45) Date of Patent: Sep. 15, 2020

(54) HYDRAULICALLY ACTUATED DOWNHOLE PUMP WITH TRAVELING VALVE

(71) Applicant: Weatherford Technology Holdings, LLC, Houston, TX (US)

(72) Inventor: Michael C. Knoeller, Humble, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 478 days.

(21) Appl. No.: 14/877,021

(22) Filed: Oct. 7, 2015

(65) Prior Publication Data

US 2016/0102536 A1 Apr. 14, 2016

Related U.S. Application Data

(60) Provisional application No. 62/062,517, filed on Oct. 10, 2014.

(51) Int. Cl.

| | |
|---|---|
| ***E21B 43/12*** | (2006.01) |
| ***F04B 53/12*** | (2006.01) |
| ***F04B 9/105*** | (2006.01) |
| ***F04B 7/02*** | (2006.01) |
| ***F04B 47/08*** | (2006.01) |
| ***F04B 53/14*** | (2006.01) |

(52) U.S. Cl.

CPC ..... *E21B 43/129* (2013.01); *F04B 7/0266* (2013.01); *F04B 9/105* (2013.01); *F04B 47/08* (2013.01); *F04B 53/12* (2013.01); *F04B 53/14* (2013.01)

(58) Field of Classification Search

None

See application file for complete search history.

(56) References Cited

U.S. PATENT DOCUMENTS 2,631,541 A 3/1953 Dempsey
2,818,022 A * 12/1957 Kangas ..... F04B 47/08 166/54.1

(Continued)

OTHER PUBLICATIONS

PCT International Search Report and Written Opinion dated Jan. 20, 2016, for International Application No. PCT/US2015/054638.

(Continued)

*Primary Examiner* — Peter J Bertheaud
*Assistant Examiner* — Geoffrey S Lee
(74) *Attorney, Agent, or Firm* — Patterson + Sheridan, LLP

(57) ABSTRACT

Embodiments of the present disclosure generally relate to a hydraulic pump with gas lock prevention. The pump includes a pump barrel having an intake port and a discharge port and a pump piston movably disposed in the pump barrel. The pump piston divides an inner volume of the pump barrel into a first pump volume connected to the discharge port and a second pump volume connected to the intake port. A pump flow path is formed through the pump piston connecting the first pump volume and the second pump volume. The pump further includes a first valve disposed in the pump flow path in the pump piston. The first valve selectively permits fluid flow from the second pump volume to the first pump volume. The pump further includes a second valve disposed at the discharge port to selectively permit fluid flow out of the first pump volume through the discharge port.

21 Claims, 4 Drawing Sheets

(56) References Cited

U.S. PATENT DOCUMENTS

RE24,812 E * 4/1960 Deitrickson ..... F04B 47/04 417/403
2,948,224 A * 8/1960 Bailey ..... F04B 47/04 417/393
2,983,227 A 5/1961 English
3,024,733 A * 3/1962 English ..... F04B 47/04 417/377
3,084,630 A * 4/1963 Massey ..... F04B 47/04 166/54.1
3,089,429 A * 5/1963 Massey ..... F04B 47/04 166/54.1
3,152,016 A * 10/1964 Drushella ..... F01L 23/00 417/397
3,222,994 A 12/1965 English
3,316,817 A * 5/1967 Ellis ..... F15B 21/044 91/422
4,118,154 A 10/1978 Roeder
4,214,854 A * 7/1980 Roeder ..... F01L 15/12 417/402
4,477,234 A * 10/1984 Roeder ..... F04B 47/08 417/393
4,598,630 A * 7/1986 Kao ..... F04B 3/00 92/129
4,627,794 A * 12/1986 Silva ..... F04B 9/115 417/225
4,768,589 A * 9/1988 Roeder ..... F04B 47/08 166/106
4,778,355 A * 10/1988 Holland ..... F04B 47/08 417/378
4,871,302 A * 10/1989 Clardy ..... F01L 25/063 417/404
4,880,363 A * 11/1989 Holland ..... F04B 47/08 417/390
6,092,416 A * 7/2000 Halford ..... E21B 49/10 166/264
6,203,289 B1 * 3/2001 Castel ..... F04B 9/1073 417/385
7,984,756 B2 * 7/2011 Dowling ..... F04B 47/022 166/105.6
8,303,272 B2 11/2012 Pugh et al.
2008/0283250 A1 * 11/2008 Simmons ..... E21B 43/121 166/369
2009/0016899 A1 * 1/2009 Davis ..... E21B 43/129 417/133
2010/0206549 A1 8/2010 Dowling et al.
2013/0195685 A1 8/2013 Robison et al.

OTHER PUBLICATIONS

Colombian Office Action dated Jun. 6, 2018, for Colombian Patent Application No. NC2017/0004339.
EPO Office Action dated Jun. 27, 2018, for European Patent Application No. 15784249.3.
Colombian Office Action dated Oct. 9, 2018, for Colombian Patent Application No. NC2017/0004339.
Australian Office Action in related application 2015330859 dated Jun. 27, 2019.
Australian Notice of Acceptance dated Oct. 14, 2019, for Australian Patent Application No. 2015330859.

* cited by examiner

HYDRAULICALLY ACTUATED DOWNHOLE PUMP WITH TRAVELING VALVE

CLAIM OF PRIORITY UNDER 35 U.S.C. 119

This application claims benefit of U.S. Provisional Patent Application No. 62/062,517, filed Oct. 10, 2014, and entitled "Hydraulically Actuated Downhole Pump with Travelling Valve" which is herein incorporated by reference in its entirety.

BACKGROUND

Field

Embodiments of the present disclosure generally relate to hydraulically activated pump.

Description of the Related Art

When reservoir pressure in a well is insufficient for the production fluid to reach the surface on its own, pumps can be used in the well to help bring production fluids to the surface. One type of pump for such operations is a hydraulically actuated pump.

A hydraulically actuated pump is typically deployed downhole in a tubing disposed in a wellbore. Surface equipment injects power fluid, e.g., produced water or oil, down the tubing to the pump. The power fluid operates to drive an engine piston internally between upstrokes and down strokes which, in turn, drives a pump piston connected to the engine piston via a rod. During upstrokes, the pump draws in production fluid to an intake pump volume below the pump piston. During down strokes, the pump transfers the production fluid from the intake pump volume to a discharge pump volume above the pump piston. In a subsequent upstroke, the production fluid is discharged from the discharge pump volume via the tubing-casing annulus or some such parallel path to the surface equipment for handling.

Hydraulically activated pumps use the incompressible characteristic of the production liquid to transfer the production liquid from the intake volume to the discharge volume and discharge the production liquid out of the discharge volume. However, in traditional hydraulically activated pumps, when gas is drawn into the intake pump volume during an upstroke, the gas in the intake volume will simply compress and expand during the subsequent down strokes and upstrokes, thereby causing the pump to gas lock. When gas lock occurs, the pump fails to move any production liquid to the surface.

There is, therefore, a need for a hydraulic pump capable of preventing gas lock.

SUMMARY

Embodiments of the present disclosure generally relate to a hydraulic pump with gas lock prevention.

One embodiment of a pump includes a pump barrel having an intake port and a discharge port, and a pump piston movably disposed in the pump barrel. The pump piston divides an inner volume of the pump barrel into a first pump volume connected to the discharge port and a second pump volume connected to the intake port. A pump flow path is formed through the pump piston connecting the first pump volume and the second pump volume. The pump further includes a first valve disposed in the pump flow path in the pump piston. The first valve selectively permits fluid flow from the second pump volume to the first pump volume. The pump further includes a second valve disposed at the discharge port to selectively permit fluid flow out of the first pump volume through the discharge port.

Another embodiment provides a hydraulic pump. The hydraulic pump comprises an engine barrel and a pump barrel and an engine piston movably disposed in the engine barrel. The engine piston divides an inner volume of the engine barrel into a first engine volume and a second engine volume. The engine barrel has an engine inlet port connecting to the inner volume. The hydraulic pump further includes a pump piston movably disposed in the pump barrel. The pump piston divides an inner volume of the pump barrel into a first pump volume and a second pump volume. The first pump volume has an outlet port and the second pump volume has an intake port. The hydraulic pump further includes a middle rod connecting the engine piston and the pump piston. The middle rod has a rod passage selectively connecting the first engine volume and the first pump volume. The hydraulic pump further includes a first check valve disposed in the pump piston to control flow from the first pump volume to the second pump volume, and a second check valve disposed to control flow from the first pump volume through the outlet port of the pump barrel.

Another embodiment provides a method for pumping production fluid from a wellbore. The method includes stroking a pump piston disposed in a pump barrel repeatedly between an upstroke and a down stroke, wherein the pump piston divides the pump barrel into a first pump volume and a second pump volume, a pump flow path is formed through the pump piston between the first pump volume and the second pump volume, and a first check valve is disposed in the pump flow path in the pump piston. The method further includes, during each upstroke, drawing production fluid into the second pump volume through an intake port through the pump barrel and discharging fluid in the first pump volume through a second check valve disposed on a discharge port through the pump barrel. The method further includes, during each down stroke, flowing the production fluid in the second pump volume to the first pump volume through the first check valve disposed in the pump piston while the second check valve remains closed.

BRIEF DESCRIPTION OF THE DRAWINGS

So that the manner in which the above recited features of the present disclosure can be understood in detail, a more particular description of the various aspects, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

Figure 1A:
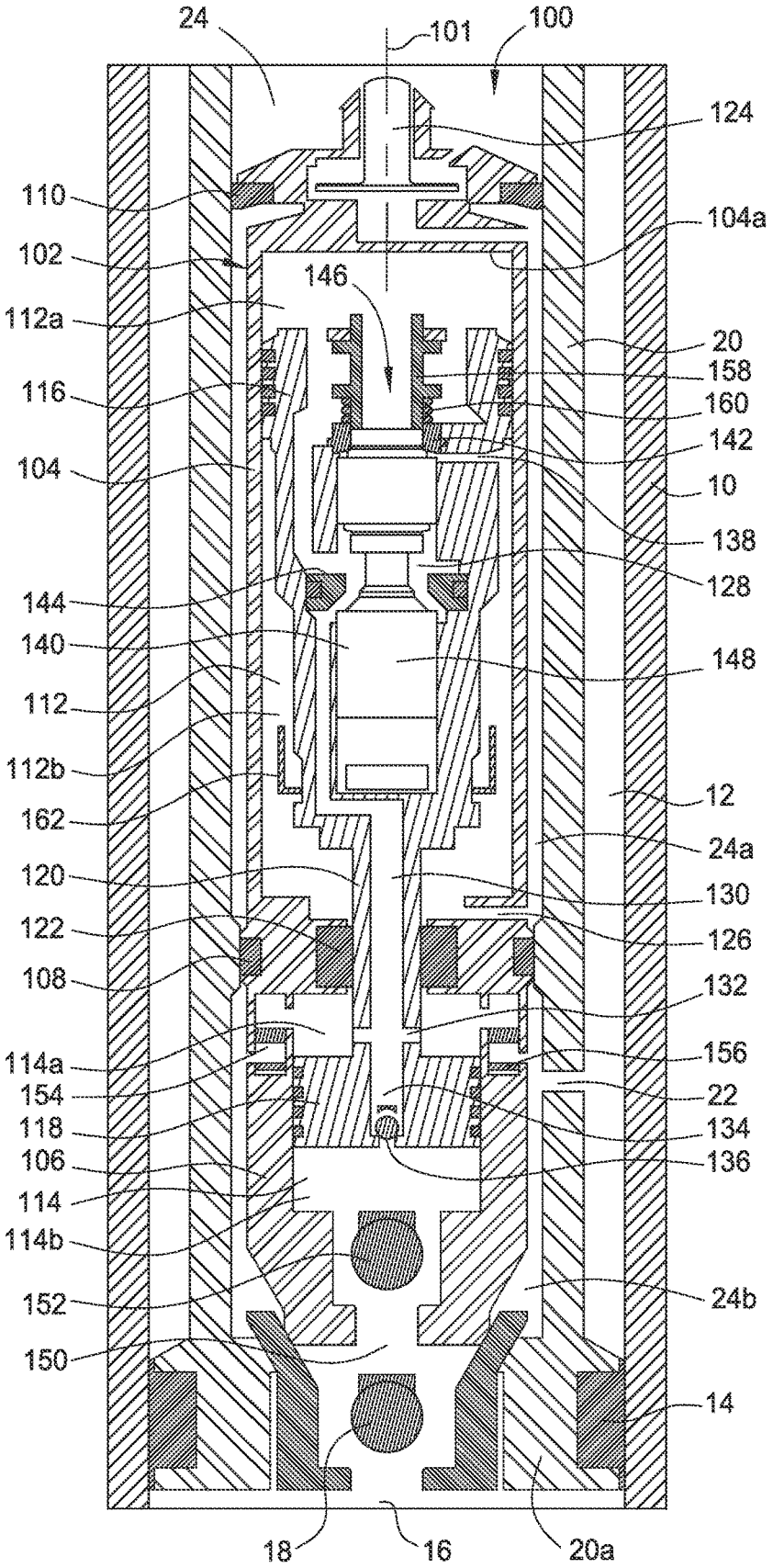
FIG. 1A is a schematic sectional view showing a hydraulic pump according to one embodiment of the present disclosure disposed in a wellbore.

To facilitate understanding, identical reference numerals have been used, where possible, to designate identical elements that are common to the figures. It is contemplated that elements disclosed in one embodiment may be beneficially utilized on other embodiments without specific recitation. The drawings referred to here should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

In the following description, numerous specific details are set forth to provide a more thorough understanding of the present disclosure. However, it will be apparent to one of skill in the art that the present disclosure may be practiced without one or more of these specific details. In other instances, well-known features have not been described in order to avoid obscuring the present disclosure.

FIG. 1A is a schematic sectional view showing one embodiment of a hydraulic pump 100 disposed in a wellbore. The hydraulic pump 100 may be used to produce production fluids from a wellbore to the surface.

FIG. 1A illustrates the hydraulic pump 100 is installed downhole in tubing 20 disposed in a wellbore casing 10. A tubing standing valve 18 may be disposed inside the tubing 20 at a lower end 20*a*. The tubing stand valve 18 selectively closes a tubing volume 24 inside the tubing 20 and a production region 16 below the tubing 20. The tubing standing valve 18 ensures that fluid flows from the production region 16 to the tubing volume 24, not vice versa. The tubing standing valve 18 also allows retrieval of the hydraulic pump 100 by pumping power fluid through an annulus 12 between the tubing 20 and the wellbore casing 10. One or more packer assembly 14 may be disposed between the tubing 20 and the wellbore casing 10 near the lower end 20*a* of the tubing 20. The one or more packer assembly 14 seals the annulus 12 from the production region 16. The tubing 20 may include one or more ports 22 near the lower end 20*a* to connect the tubing volume 24 and the annulus 12.

The hydraulic pump 100 may be disposed in the tubing volume 24 near the lower end 20*a* to pump production fluid in the production region 16 to the annulus 12. The hydraulic pump 100 may include a housing 102. The housing 102 has an engine barrel 104 and a pump barrel 106. A seating cup 108 may be disposed on the housing 102 between the engine barrel 104 and the pump barrel 106. The seating cup 108 is configured to contact an inner wall of the tubing 20 and form a seal with the tubing 20. The seating cup 108 seals a pump tubing volume 24*b* between the pump barrel 106 and the tubing 20. The port 22 connects the pump tubing volume 24*b* to the annulus 12. A sealing member 110 may be disposed on the housing 102 above the engine barrel 104. The sealing member 110 is configured to contact the inner wall of the tubing 20 and form a seal with the tubing 20. The seating cup 108 and the sealing member 110 seal an engine tubing volume 24*a* between the engine barrel 104 and the tubing 20.

The hydraulic pump 100 may include an engine check valve 124 disposed above the engine barrel 104. The engine check valve 124 allows fluid, such as a power fluid, to enter the engine tubing volume 24*a*. The engine barrel 104 encloses an engine volume 112 therein. The engine barrel 104 may have an engine inlet port 126 connecting the engine volume 112 to the engine tubing volume 24*a*. The engine inlet port 126 may be positioned to connect the lower engine volume 112*b* to the engine tubing volume 24*a*. An engine piston 116 is movably disposed in the engine barrel 104. The engine piston 116 divides the engine volume 112 into an upper engine volume 112*a* and a lower engine volume 112*b*.

The pump barrel 106 encloses a pump volume 114 therein. A pump piston 118 may be movably disposed in the pump barrel 106. The pump piston 118 divides the pump volume 114 into an upper pump volume 114*a* and a lower pump volume 114*b*. A middle rod 120 is coupled between the engine piston 116 and the pump piston 118. The middle rod 120 enables the engine piston 116 and the pump piston 118 to move in synchrony along a central axis 101 of the hydraulic pump 100. The engine piston 116 and the pump piston 118 move back and forth along the central axis 101 changing sizes of the upper engine volume 112*a*, the lower engine volume 112*b*, the upper pump volume 114*a* and the lower pump volume 114*b*. A rod seal 122 may be disposed inside the housing 102 between the engine barrel 104 and the pump barrel 106. The rod seal 122 forms a seal around the middle rod 120 to fluidly isolate the pump volume 114 from the engine volume 112.

In one embodiment, the engine piston 116 has an inner chamber 128 formed therein. The inner chamber 128 opens to the upper engine volume 112*a*. The inner chamber 128 has an upper port 138 and a lower port 140. The upper port 138 is connected to the lower engine volume 112*b*. The lower port 140 is connected to a rod passage 130 formed through the middle rod 120. The rod passage 130 may be connected to the upper pump volume 114*a* through one or more upper outlet 132.

In one embodiment, a reversing valve 146 may be disposed in the inner chamber 128 of the engine piston 116. The reversing valve 146 alternatively connects the upper engine volume 112*a* to the lower engine volume 112*b* and the rod passage 130. The reversing valve 146 may include a piston 148 disposed in the inner chamber 128. The piston 148 is movable vertically within the inner chamber 128 between an upper pressure seat 142 and a lower pressure seat 144. When the piston 148 is in contact with the upper pressure seat 142, the upper engine volume 112*a* is connected with the lower engine volume 112*b* through the upper port 138. When the piston 148 is in contact with the upper pressure seat 142, the upper engine volume 112*a* is connected with the rod passage 130 through the lower port 140.

A push rod 158 may be disposed on the engine piston 116. A bias element 160 may be attached to the push rod 158 to bias the push rod 158 away from the piston 148 of the reversing valve 146. As the engine piston 116 moves upwards, the push rod 158 may become in contact with an upper wall 104*a* of the engine barrel 104. The upper wall 104*a* pushes the push rod 158 and the push rod 158 compresses the bias element 160 to move downward. If the piston 148 of the reversing valve 146 is in contact with the upper pressure seat 142 when the push rod 158 is moving down, the push rod 158 contacts the piston 148 and pushes the piston 148 down to reverse the position of the reversing valve 146. Similarly, a lower push rod 162 disposed at an opposite end of the piston 148 to push the piston 148 up when the engine piston 116 is at a lower most position and the piston 148 of the reversing valve 146 is in contact with the lower pressure seat 144.

In one embodiment, the rod passage 130 may extend through the pump piston 118 and open to the lower pump volume 114*b* through a lower outlet 134. Thus, the rod passage 130 provides a fluid communication between the lower pump volume 114*b* and the upper pump volume 114*a*. A traveling valve 136 may be disposed in the pump piston 118 to selectively open the lower outlet 134. The traveling valve 136 allows fluid flow from the lower pump volume 114*b* to the rod passage 130 and prohibits fluid flow from the rod passage 130 to the lower pump volume 114. Alternatively, the fluid passage from the lower pump volume 114*b* to the upper pump volume 114*a* may be an independent flow path formed through the pump piston 118 and not connected to the rod passage 130.

The pump barrel 106 may include an intake port 150. The intake port 150 may be formed through a lower end of the pump barrel 106 to draw up production fluid into the lower pump volume 114*b*. An intake valve 152 may be disposed in the intake port 150 to selectively open and close the intake port 150. The intake valve 152 may be a check valve to ensure that fluid only flow into the pump volume 114 not out of the pump volume 114.

The pump barrel 106 may also include a discharge port 154. The discharge port 154 may be formed through an upper end of the pump barrel 106 to connect the upper pump volume 114*a* to the pump tubing volume 24*a*. A discharge valve 156 may be disposed in the pump barrel 106 to selectively open and close the discharge port 154. In one embodiment, the discharge valve 156 may be a disk valve having a valve body with a set of ports and a disk plate with sealing members configured to seal the set of ports in the valve body. In one embodiment, the discharge valve 156 may be disk valve including a self-cleaning mechanism configured to cause a disturbance in fluid flow within or near the valve body when the disk plate is sealing or unsealing the set of ports. The disturbance in the fluid flow may impede, remove and/or displace debris buildup on a surface of the valve body. The self-cleaning mechanism may include one or more cut outs formed a surface of the valve body in proximity to the set of ports. Alternatively, the discharge valve 156 may be any suitable valves, for example any suitable pressure activated valves, such as a ball and seat valve and a flapper valve.

Figure 1B:
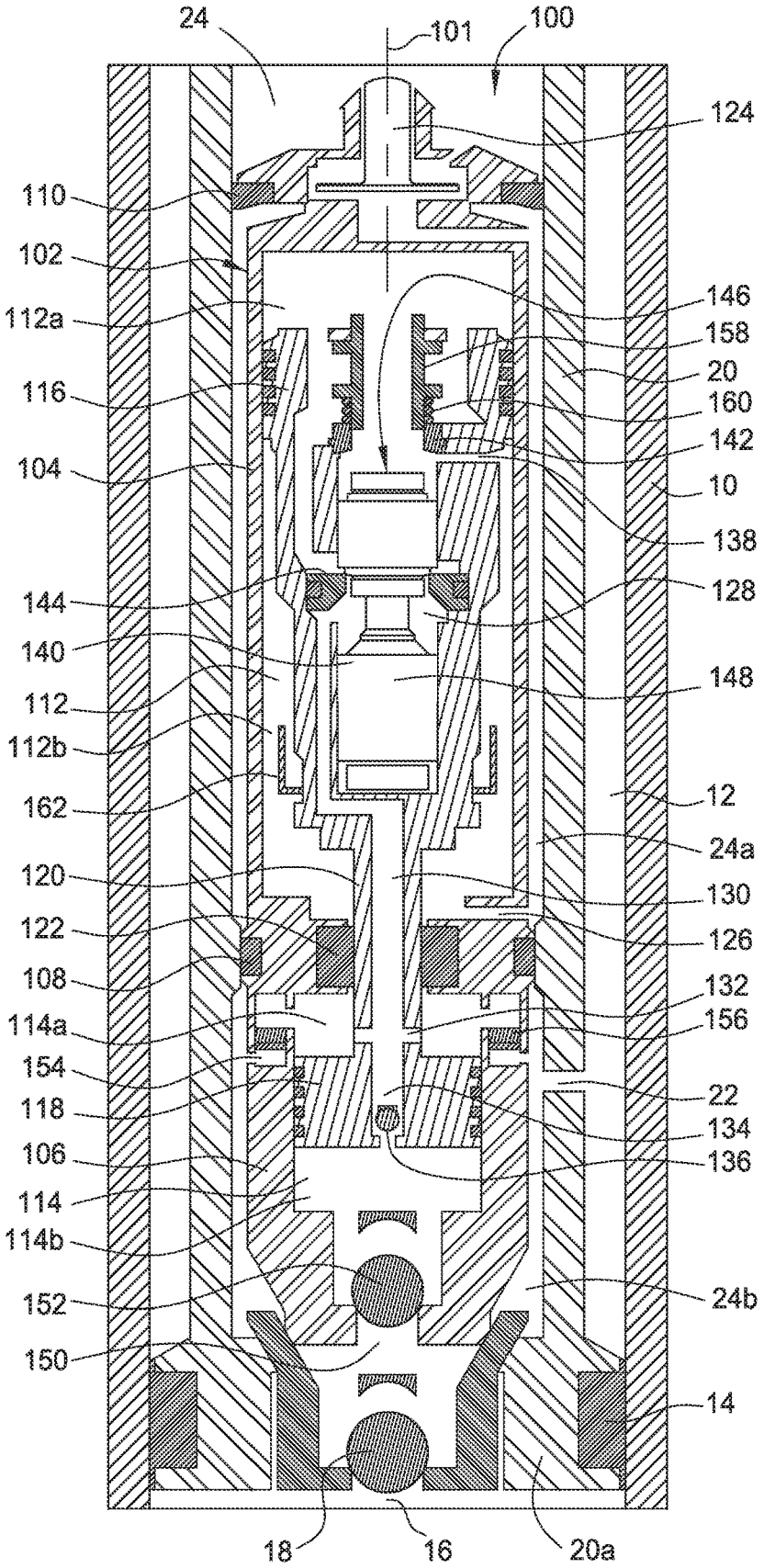
FIG. 1B is a schematic sectional view showing the hydraulic pump of FIG. 1A during a down stroke.

During operation, the hydraulic pump 100 may be disposed at the lower end 20*a* of the tubing 20 with the pump barrel 106 facing the production region 16 and the engine barrel 104 away from the production region 16. The hydraulic pump 100 may be positioned against the tubing standing valve 18. The seating cup 108 and the sealing member 110 are pressed against the inner surface of the tubing 20 to seal off the pump tubing volume 24*b* and the engine tubing volume 24*a* from each other and from the remaining tubing volume 24 above the hydraulic pump 100. A power fluid may be applied from surface through the tubing volume 24 to drive the engine piston 116 and the pump piston 118 up and down the engine barrel 104 and the pump barrel 106. FIG. 1A schematically illustrates the hydraulic pump 100 when the engine piston 116 and the pump piston 118 are moving up, i.e. during an upstroke. FIG. 1B schematically illustrates the hydraulic pump 100 when the engine piston 116 and the pump piston 118 are moving down, i.e. during a down stroke.

Figure 2A:
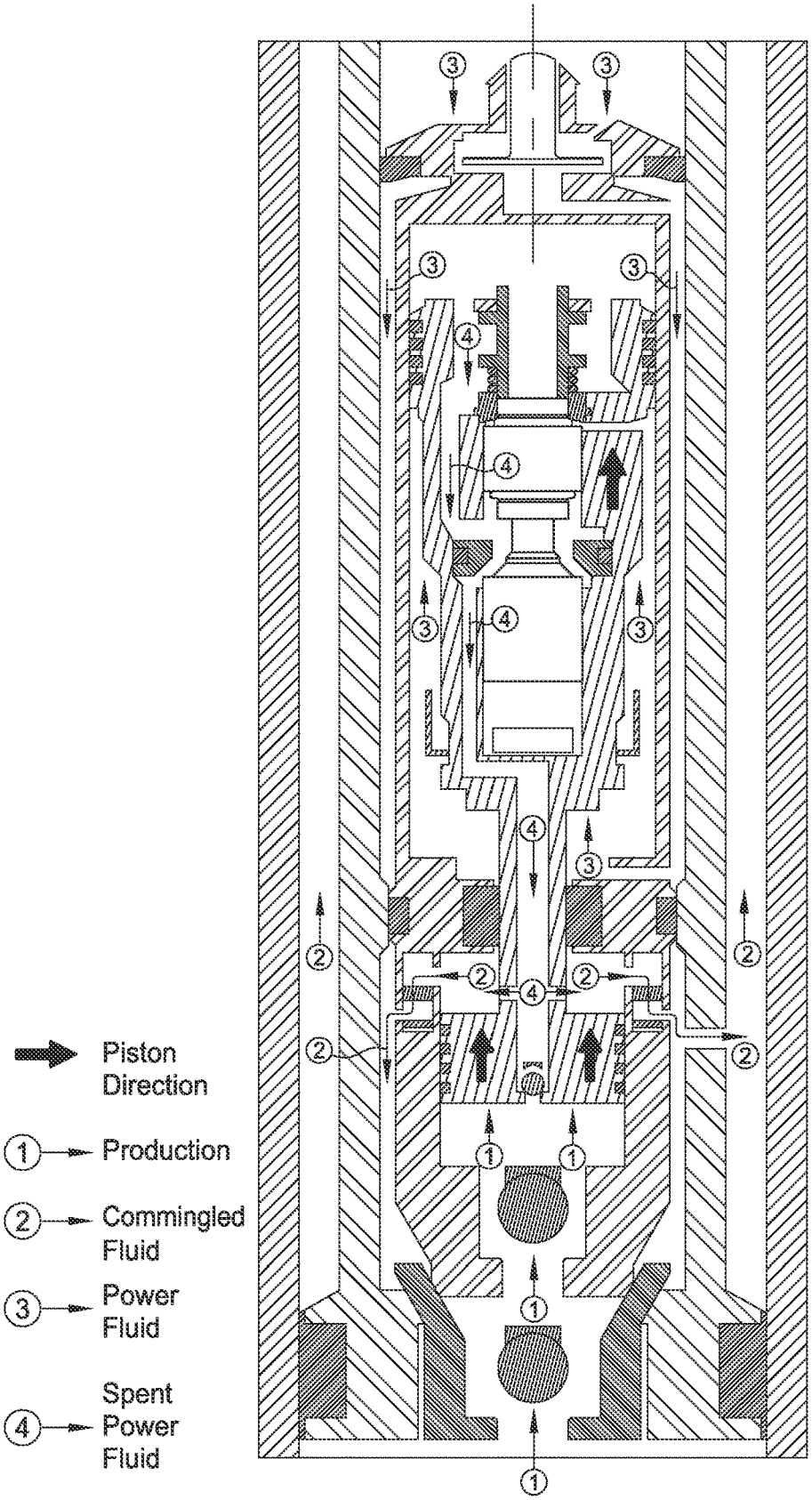
FIG. 2A schematically illustrates the directions of fluid flow in the hydraulic pump of FIG. 1A during an upstroke.

FIG. 2A schematically illustrates the directions of fluid flow during upstroke. During upstroke, the reversible valve 146 is in contact with the upper pressure seat 142 causing the inlet port 138 to be closed by the reversible valve 146 while the outlet port 140 is open. The closure of the inlet port 138 prevents fluid flow from the lower engine volume 112*b* to the upper engine volume 112*a*. The opening of the outlet port 140 allows fluid flow from the upper engine volume 112*a* to the bump volume 114 through the rod passage 130.

As shown in FIG. 2A, the power fluid in the tubing volume 24 enters the engine tubing volume 24*a* through the engine check valve 124. The power fluid then enters the lower engine volume 112*b* through the engine inlet port 126. Because the inlet port 138 is blocked by the reversible valve 146, the power fluid remains in the lower engine volume 112*b*. The pressure of the power fluid in the lower engine volume 112*b* increases until it overcomes the pressure of the fluid in the upper engine volume 112*a*, thereby moving the engine piston 116 upward. The upstroke of the engine piston 116 reduces the upper engine volume 112*a*, which forces the fluid in the upper engine volume 112*a* to flow through the outlet port 140 and into the rod passage 130.

The upstroke of the engine piston 116 is translated to the pump piston 118 through the middle rod 120. Upward movement of the pump piston 118 enlarges the volume of the lower pump volume 114*b* and reduces the volume of the upper pump volume 114*a*. The pressure in the lower pump volume 114*b* decreases as a result of enlarging the volume of the lower pump volume 114. When the pressure in the lower pump volume 114*b* is lower than the pressure of the production region 16, the check valves 18 and 152 open to draw the production fluid into the lower pump volume 114.

Because the travelling valve 136 is closed during the upstroke, fluid communication between the rod passage 130 and the lower pump volume 114*b* is blocked. The fluid in the rod passage 130 enters into the upper pump volume 114*a* through the upper outlet 132 of the rod passage 130. In this respect, the upper pump volume 114*a* contains a mixture of the production fluid and the power fluid (commingled fluid). Both the introduction of fluid into the upper pump volume 114*a* and the reduction in volume of the upper pump volume 114*a* contributes to the increase in pressure of the upper pump volume 114*a* during the upstroke. When the pressure in the upper volume 114*a* reaches the opening pressure of the discharge valve 156, the discharge valve 156 opens to allow fluid from the upper pump volume 114*a* to exit into the pump tubing volume 24*b*, then through the port 22 to the annulus 12, and then to the surface. The expelled fluid is a mixture of production fluid and power fluid (commingled fluid).

As the engine piston 116 moves to its upper location, the push rod 158 will contact the top wall 104*a* of the engine barrel 104. The push rod 158 moves relative to the engine piston 116 and compresses the bias element 160. The push rod 158 then contacts and pushes the piston 148 of the reversing valve 146. In response, the reversible valve 146 moves downward within the inner chamber 128, thereby opening the inlet port 138 and closing the lower port 140. The power fluid from the lower engine volume 112*b* flows through the inlet port 138 and into the upper engine volume 112*a*. The flow of power fluid into the upper engine volume 112*a* causes the upper engine volume 112*a* to expand and the engine piston 116 to move down, thus, starting a down stroke.

Figure 2B:
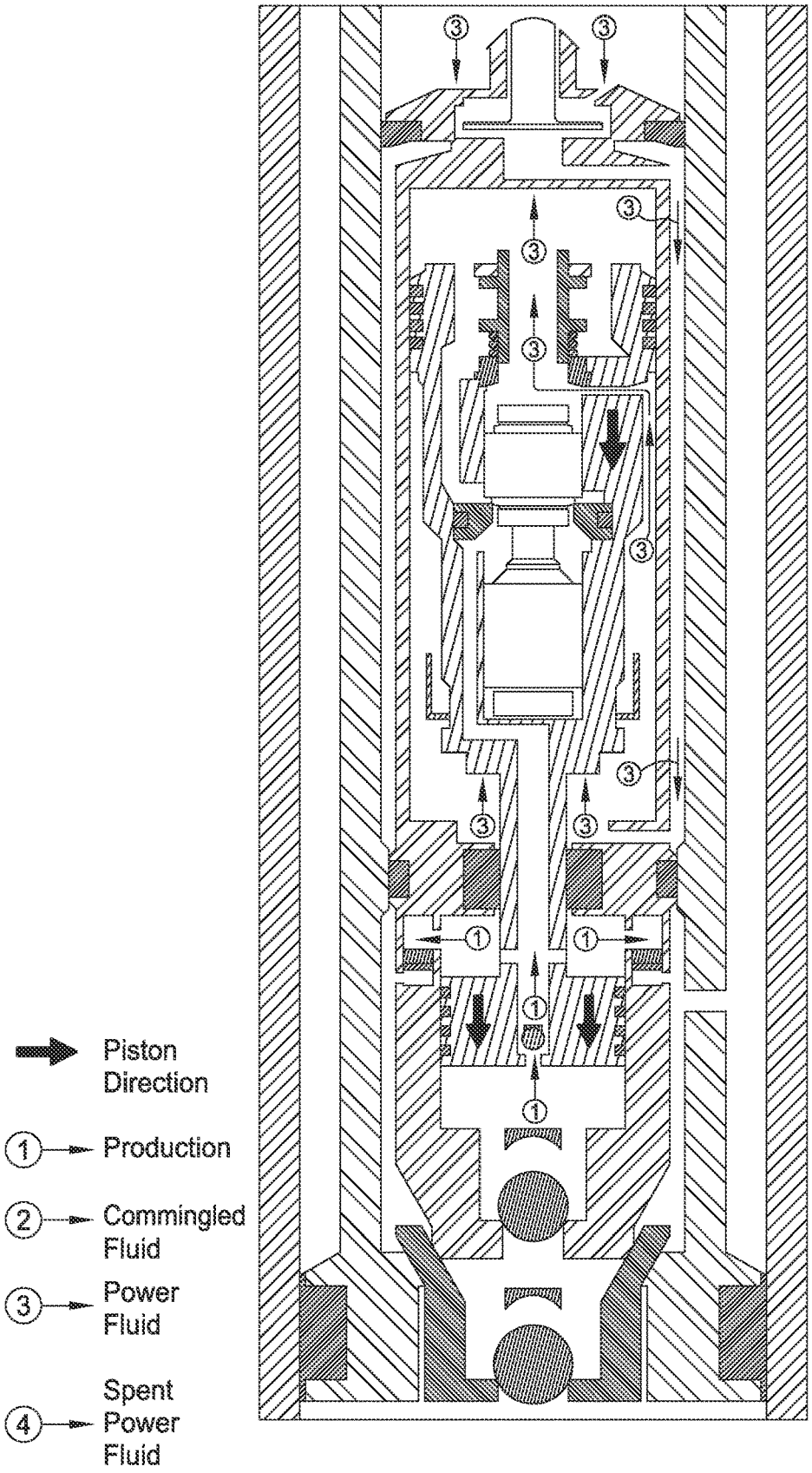
FIG. 2B schematically illustrates the directions of fluid flow of the hydraulic pump of FIG. 1A during a down stroke.

FIG. 2B schematically illustrates the directions of fluid flow during a down stroke. After the reversing valve 146 reverses its position at the top of an upstroke, power fluid flows from the lower engine volume 112*b* to the upper engine volume 112*a* through the inlet port 138. The upper engine volume 112*a* expands to push down the engine piston 116 and the pump piston 118. When the lower port 140 is closed, the upper pump volume 114*a* loses the pressure from the power fluid. The upper pump volume 114*a* also loses pressure because the upper pump volume 114*a* is expanding due to the pump piston 118 moving downward. The discharge valve 156 is closed as a result of the pressure drop in the upper pump volume 114*a*. The downward movement of the pump piston 118 also reduces the volume of the lower pump volume 114*b*, thereby causing the pressure in the lower pump volume 114*b* to increase. The increased pressure in lower pump volume 114*b* opens the travelling valve 136 and closes the intake valve 152. Thus, during a down stroke, the production fluid in the lower pump volume 114*b* flows into the upper pump volume 114*a* through the travelling valve 136.

When the engine piston 116 is moving downward to its bottom location, the reversing valve 146 may be reversed to open the lower port 140 and close the inlet port 138 to start the next upstroke. During the next upstroke, new production fluid may be drawn into the lower pump volume 114*a*, and the production fluid in the upper pump volume 114*a* will be discharged through the discharge valve 156 along with the spent power fluid in the upper engine volume 112*a*.

The hydraulic pump 100 according to the present disclosure has several advantages over traditional hydraulic pumps. For example, the hydraulic pump 100 is configured to prevent gas lock and is effective in high gas content wells, for example, horizontal shale well completions. As described above, during upstroke, when the production fluid in the upper pump volume 114*a* is being discharged into the annulus 12, the upper pump volume 114*a* is in fluid communication with the upper engine volume 112*a* so that the upper pump volume 114*a* is pressurized by the power fluid in the upper engine volume 114*a*. The pressure of the power fluid from the upper engine volume 112*a* provides sufficient pressure to open the discharge valve 156 to discharge the high gas content production fluid into the annulus 12. Even if the production fluid in the lower engine volume 114*b* includes a high percentage of compressive fluid, such as gas, the discharge check valve 156 isolates the upper pump volume 114*a* from the fluid pressure in the annulus 12 to permit the fluid in the lower engine volume 114*b* to be transferred to the upper engine volume 114*a* during down stroke, thus preventing gas lock in the lower engine volume 114*b*.

Additionally, compared to traditional pumps with gas lock preventing mechanism, the hydraulic pump 100 includes a simplified and more robust structure. Traditional gas lock preventing mechanism includes two check valves positioned next to each other on the pump barrel for intake and discharge respectively resulting in a complex structure. By using the travelling valve 136 in the pump piston 118 to control the intake of production fluid in the upper pump volume 114*a*, the hydraulic pump 100 of the present disclosure provides a simplified solution for gas lock prevention.

While the foregoing is directed to embodiments of the present disclosure, other and further embodiments may be devised without departing from the basic scope thereof, and the scope thereof is determined by the claims that follow.

The invention claimed is:

1. A pump, comprising:

a pump barrel having an intake port and a discharge port, wherein the discharge port is formed through a tubular wall of the pump barrel;

a pump piston movably disposed in the pump barrel, wherein the pump piston divides an inner volume of the pump barrel into a first pump volume fluidly connected to the discharge port and a second pump volume fluidly connected to the intake port;

a middle rod coupled to the pump piston, and wherein a pump flow path is formed through the pump piston and the middle rod, the pump flow path provides fluid communication between the first pump volume and the second pump volume, and the middle rod has an upper outlet connecting the pump flow path and the first pump volume, and the pump piston has a lower outlet connecting the pump flow path and the second pump volume;

a first valve disposed in the pump piston at the lower outlet, wherein the first valve selectively permits fluid flow from the second pump volume to the first pump volume; and a second valve disposed in the tubular wall of the pump barrel to selectively permit fluid flow out of the first pump volume through the discharge port.

2. The pump of claim 1, wherein the second valve is pressure activated valve.

3. The pump of claim 2, wherein the first valve and the second valve are individually selected from the group consisting of a check valve, a disk valve, a ball and seat valve, and a flapper valve.

4. The pump of claim 1, further comprising:

an engine barrel;

an engine piston movably disposed in the engine barrel wherein the middle rod is rigidly coupled between the engine barrel and the pump piston so that the engine piston drives the pump piston.

5. The pump of claim 4, wherein the middle rod has a rod passage formed therethrough, and the rod passage selectively permits a power fluid from the engine barrel to the first pump volume.

6. The pump of claim 5, wherein the rod passage is connected to the pump flow path.

7. The pump of claim 1, further comprising a third valve disposed at the intake port to selectively permit fluid flow into the second pump volume through the intake port.

8. A hydraulic pump, comprising:

an engine barrel;

a pump barrel;

an engine piston movably disposed in the engine barrel, wherein the engine piston divides an inner volume of the engine barrel into a first engine volume and a second engine volume, and the engine barrel has an engine inlet port connecting to the inner volume;

a pump piston movably disposed in the pump barrel, wherein the pump piston divides an inner volume of the pump barrel into a first pump volume and a second pump volume, the first pump volume is connected to an outlet port formed through a tubular wall of the pump barrel, and the second pump volume is connected to an intake port;

a middle rod connecting the engine piston and the pump piston, wherein a rod passage is formed through the engine piston, the pump piston and the middle rod, the rod passage selectively connects the first engine volume and the first pump volume, and the middle rod has an upper outlet connecting the rod passage and the first pump volume, and the pump piston has a lower outlet connecting the rod passage and the second pump volume;

a first check valve disposed in the pump piston at the lower outlet to control flow from the first pump volume to the second pump volume; and a second check valve disposed in the tubular wall of the pump barrel to control flow from the first pump volume through the outlet port of the pump barrel.

9. The hydraulic pump of claim 8, further comprising an intake valve disposed to control flow from the intake port of the pump barrel to the second pump volume.

10. The hydraulic pump of claim 8, further comprising a reversing valve movable to alternatively connect the first engine volume to the second engine volume or the first pump volume.

11. The hydraulic pump of claim 8, wherein the second check valve is pressure activated check valve.

12. The hydraulic pump of claim 11, wherein the second check valve is selected from a disk valve, a ball and seat valve, and a flapper valve.

13. The hydraulic pump of claim 8, wherein the engine inlet port open to the second engine volume, and the engine inlet port is configured to receive power fluid for driving the hydraulic pump.

14. The hydraulic pump of claim 8, further comprising: a seating cup disposed outside a housing between the engine barrel and the pump barrel, wherein the seating cup is configured to form a seal with a tubing, wherein the housing includes the engine barrel and the pump barrel.

15. The hydraulic pump of claim 14, further comprising: an engine check valve disposed above the engine barrel.

16. The hydraulic pump of claim 15, further comprising a sealing member disposed outside the housing and between the engine check valve and the engine barrel.

17. The hydraulic pump of claim 8, further comprising a reversing valve disposed in the engine piston and moveable relative to the engine piston to alternatively connect the first engine volume to the second engine volume or the first pump volume, and a push rod disposed in the engine piston configured to reverse a position of the reversing valve.

18. A method for pumping production fluid from a wellbore, comprising:

stroking a pump piston disposed in a pump barrel repeatedly between an upstroke and a down stroke via a middle rod coupled to the pump piston, wherein the pump piston divides the pump barrel into a first pump volume and a second pump volume, and includes a pump flow path between the first pump volume and the second pump volume, the pump flow path is formed through the pump piston and the middle rod, and the pump flow path has an upper outlet open at the middle rod facing the first pump volume and a lower outlet open at the pump piston facing the second pump volume;

during each upstroke:

drawing production fluid into the second pump volume through an intake port of the pump barrel while the lower outlet is closed by a first valve disposed in the pump piston; and discharging fluid in the first pump volume through a discharge port formed in a tubular wall of the pump barrel; and during each down stroke:

flowing the production fluid in the second pump volume to the first pump volume via the first valve in the pump flow path formed through the pump piston while the discharge port remains closed by a second valve disposed in the tubular wall of the pump barrel.

19. The method of claim 18, wherein stroking the pump piston comprises:

deploying a power fluid down a tubing; and stroking an engine piston disposed in an engine barrel between an upstroke and a down stroke, wherein the engine piston is rigidly attached to the pump piston by a middle rod.

20. The method of claim 19, further comprising:

during each up stroke, flowing the power fluid from the engine barrel to the first pump volume through a rod passage formed through the middle rod.

21. The method of claim 18, wherein discharging the fluid in the first pump volume comprises pressurizing the first pump volume to above an opening pressure of the second valve.

* * * * *